US005349725A

United States Patent [19]

Levy

[11] Patent Number: 5,349,725

[45] Date of Patent: * Sep. 27, 1994

[54] JEWELRY CLOSURE HAVING A MAGNETIC CLASP WITH SAFETY FEATURES

[75] Inventor: Davida Levy, Surfside, Fla.

[73] Assignee: Davida Enterprises, Inc., Miami, Fla.

[ * ] Notice: The portion of the term of this patent subsequent to Apr. 23, 2008 has been disclaimed.

[21] Appl. No.: 976,213

[22] Filed: Nov. 13, 1992

Related U.S. Application Data

[63] Continuation-in-part of Ser. No. 536,777, Jun. 12, 1990, Pat. No. 5,008,984, Ser. No. 688,102, Apr. 19, 1991, Pat. No. 5,092,019, and Ser. No. 844,863, Mar. 2, 1992.

[51] Int. Cl.[5] ..... A44B 21/00; A44C 5/00

[52] U.S. Cl. ..... 24/303; 24/616; 63/15.7

[58] Field of Search ..... 24/303, 616, 615, 618, 24/662, 106, 3 J, 3 K, 671, 673, 674, 163 K; 292/251.5; 70/459, 457; 63/15.1, 15.3, 15.7

[56] References Cited

U.S. PATENT DOCUMENTS

| | | | |
|---|---|---|---|
| 1,807,293 | 5/1931 | Keller | 24/616 |
| 2,178,572 | 11/1939 | Forstner | 24/616 |
| 2,654,929 | 10/1953 | Feibelman | 70/459 |
| 3,129,477 | 4/1964 | Mizuno et al. . | |
| 3,263,444 | 8/1966 | Di Croce . | |
| 3,566,616 | 3/1971 | Benedict . | |
| 4,543,692 | 10/1985 | Ode et al. | 24/163 K |
| 4,745,667 | 5/1988 | Conte | 24/616 |
| 4,763,490 | 8/1988 | Bruner . | |
| 4,790,148 | 12/1988 | Faini . | |
| 4,991,409 | 2/1991 | Creates . | |
| 5,008,984 | 4/1991 | Levy . | |
| 5,092,019 | 3/1992 | Levy . | |
| 5,136,858 | 8/1992 | Bruner . | |

*Primary Examiner*—Victor N. Sakran
*Attorney, Agent, or Firm*—Keck, Mahin & Cate

[57] ABSTRACT

A jewelry closure includes a magnetic closure and a mechanical closure which is a safety feature, preventing the magnetic closure from being opened inadvertently. A plate-like mechanical closure member attached to one of the magnetic closure members engages a complementarily shaped portion of the other magnetic closure member when the magnetic closure is secured to provide a mechanical second closure for the jewelry. The combined magnetic and mechanical jewelry closure may be used to close chains. The closure may also be disposed on a hinged ring. The ring may be used for passing through ends of a decorative chain as a closure for the chain. The closure may also be used on a hinged ring for wearing on a finger and is particularly useful if the finger joints are swollen. Other uses include adaptation for a hinged charm for closing a chain or for adding to a chain.

15 Claims, 1 Drawing Sheet

JEWELRY CLOSURE HAVING A MAGNETIC CLASP WITH SAFETY FEATURES

RELATED APPLICATIONS

This application is a continuation-in-part of Ser. No. 536,777, filed Jun. 12, 1990, now U.S. Pat. No. 5,008,984, issued Apr. 23, 1991; Ser. No. 688,102, filed Apr. 19, 1991, now U.S. Pat. No. 5,092,019, issued Mar. 3, 1991; and Ser. No. 07/844,863, filed Mar. 2, 1992, presently pending.

BACKGROUND OF THE INVENTION

In my previous patents, magnetic jewelry closures including mechanical safety features have been described. Such closures are satisfactory for their intended purposes, but are not suitable for all purposes for which jewelry closures are used. Also the mechanical safety features on these closures have not been as simple or economical to make as the jewelry closures described herein.

Known magnetic closures include that shown in Mizuno, U.S. Pat. No. 3,129,477. Such a magnetic closure, without a safety feature may have a perceived lack of strength due to the absence of a conventional closure. U.S. Pat. No. 3,263,444, to Di Croce, describes a hinged ring having a magnetic closure in FIG. 3 thereof. This closure also has no safety features. U.S. Pat. Nos. 3,566,616; 4,763,490; 4,790,148; 4,991,409; and 5,136,858 each show hinged rings having mechanical closures only which are relatively complex and/or expensive to make as a dual closure is not provided for added safety.

SUMMARY OF THE INVENTION

The invention provides a jewelry closure having both a magnetic closure and a mechanical safety closure. This jewelry closure is suitable for use for closing necklaces, bracelets or other articles of jewelry and is also suitable for using in combination with a hinged portion to make a hinged ring, hinged charms or a hinged jewelry closure.

A jewelry closure of the invention includes a magnetic closure and a mechanical closure which is a safety feature, preventing the magnetic closure from being opened inadvertently. A plate-like mechanical closure member attached to one of the magnetic closure members engages a complementarily shaped portion of the other magnetic closure member when the magnetic closure is secured to provide a mechanical second closure for the jewelry. The combined magnetic and mechanical jewelry closure may be used to close chains. The closure may also be disposed on a hinged ring. The ring may be used for passing through ends of a decorative chain as a closure for the chain. The closure may also be used on a hinged ring for wearing on a finger and is particularly useful if the finger joints are swollen. Other uses include adaptation for a hinged charm for closing a chain or for adding to a chain.

An object of the invention is to provide a jewelry closure having a magnetic closure with an additional mechanical safety closure.

Another object of the invention is to provide a hinged jewelry closure having a magnetic closure with an additional mechanical safety closure.

A further object of the invention is to provide a hinged magnetic jewelry closure with mechanical safety features for charms or other items.

DETAILED DESCRIPTION OF THE PREFERRED EMBODIMENTS

A jewelry closure of the invention includes a magnetic closure having first and second closure members for engaging together magnetically, at least one of said first and second closure members including a magnet. A mechanical closure in addition to the magnetic closure has a mechanical closure member attached to the first closure member for engaging a complementary portion of the second closure member when the second closure member is held by magnetic attraction to the first closure member. The mechanical closure has a plate-like member including a shaped portion and the second closure member has a complementary shaped portion which engages the shaped portion when the magnetic and mechanical closures are secured.

Typically, the shaped portion may a bead and the complementarily shaped portion may be a socket in which the bead is engaged when the magnetic and mechanical closures are secured. Alternatively, the socket may be on the plate-like portion and the bead may be disposed on the other magnetic member. Alternatively, the shaped portion may be an elongated ridge and the complementarily shaped portion may be an elongated channel in which the ridge is engaged when the magnetic and mechanical closures are secured. Likewise, the channel may be included in the shaped portion and the ridge may be disposed on the other magnetic member.

In another embodiment, the jewelry closure includes first and second elongated members and the first closure member and second closure member are disposed on first ends thereof, second ends of said first and second elongated members being hinged together to form a ring when said magnetic and mechanical closures are secured. A hinged ring closure may be used in several ways. The ring may be used as a closure for two ends of a chain necklace, bracelet or anklet by slipping ends of the ring through links in both ends of the chain and then closing the hinged ring with the dual magnetic and mechanical closure. Decorative items, such as charms, may be slipped over the hinged ring for a more ornamental appearance.

A ring of the invention may also be attached to charms for attaching ends of a bracelet or for attaching to links of a bracelet or necklace. An intermediate portion of the ring may be soldered to the charm, leaving the hinge and ends free for opening and closing. In another embodiment, it may be more convenient to divide one part of the ring into two parts for soldering to a charm. Any arrangement which allows the hinge and closure to be operative may be used.

An important embodiment of the invention is the use of the closure described and illustrated for a hinged ring for wearing on a finger of the user. The ability to open and close a hinged ring is necessary for persons having swollen finger joints who could not otherwise wear a ring.

Figure 1:
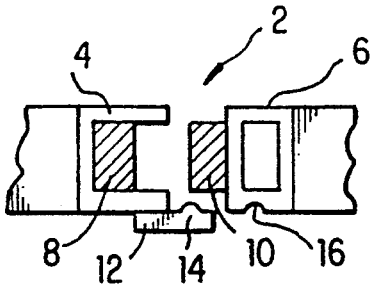
FIG. 1 is schematic cross-sectional view of a jewelry closure of the invention in open position.

With reference to FIGS. 1 to 10, in which like numerals represent like elements, FIG. 1 illustrates jewelry closure 2 having a first magnetic closure member 4 and a second magnetic closure member 6. Magnet 8 is secured, adhesively or as otherwise known in the art, to member 4 and magnet 10 is similarly secured to member 6. The mechanical safety closure is formed by plate 12 secured by welding, molding or as otherwise known in the art, having shaped portion 14 which engages in a complementarily shaped portion 16 on member 6. Plate 12 may be made separately from member 4 or may be made together with member 4, as part of the casing for magnet 8.

Figure 3:
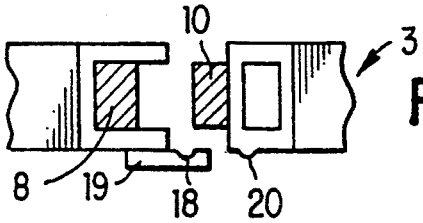
FIG. 3 is a schematic cross-sectional view of another jewelry closure, in open position.
Figure 4:
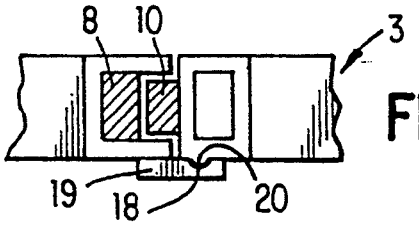
FIG. 4 is a schematic cross-sectional view of a jewelry closure of FIG. 3, in closed position.
Figure 2:
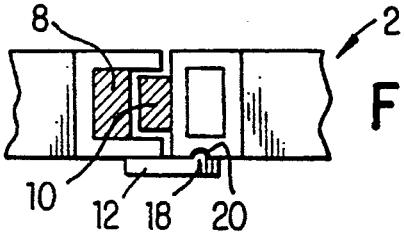
FIG. 2 is a schematic cross-sectional view of a jewelry closure of FIG. 1, in closed position.

Shaped portion 14 may be a bead 14 in plate 12, as shown in FIG. 1, or a socket 18 in plate 19, as shown in jewelry closure 3, shown in FIG. 3, into which bead 20 is engaged when the closure is joined. FIGS. 2 and 4 show the closures of FIGS. 1 and 3, respectively, in closed position.

Figure 5:
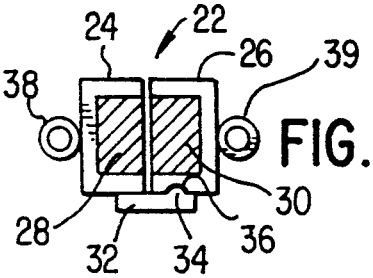
FIG. 5 is a schematic cross-sectional view of another jewelry closure of the invention, in closed position, adapted for attaching to a chain.

FIG. 5 shows another jewelry closure 22, in closed position, in which closure members 24, 26 include magnets 28, 30. The two halves of the closure come together magnetically and plate 32 has bead 34 which engages socket 36, in closed position as shown. Jewelry closure 22 has rings 38, 39 for attaching jewelry items, such as chains. As discussed above, the bead and socket are interchangeable in position.

Figure 7:
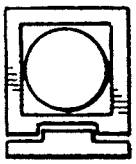
FIG. 7 is a radial cross-sectional view of another closure in secured position.
Figure 6:
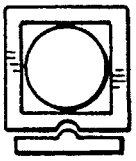
FIG. 6 is a radial cross-sectional view of a closure in secured position.

The plates, illustrated here as plates 12, 19 and 32, may be rectangular, oval or other shape which can receive a bead or socket. The bead may be a portion of a sphere, as shown in FIG. 6, or may be an elongated ridge, as shown in FIG. 7. The socket is shaped correspondingly, to receive a bead, as shown in FIG. 6, or as an elongated channel to receive an elongated ridge shaped projection, as shown in FIG. 7. The plate may be as wide as the jewelry closure, as shown in FIG. 7, or narrower than the closure, as shown in FIG. 6, as long as the mechanical closure closes securely.

The closures may have any appropriate shape, for example they may have a circular, oval, square, rectangular, hexagonal or other cross-sectional shape, as known in the art. Preferably the shape is such that magnets having a circular face may be used, but any shape of magnet may be used according to the purpose of the closure. FIGS. 6 and 7 show closures having a square cross-section enclosing circular magnets.

Figure 8:
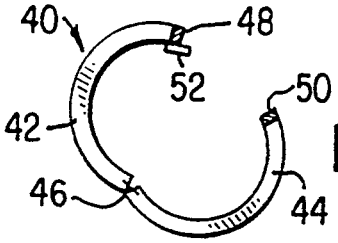
FIG. 8 is a schematic elevational view, partly in cross-section, of a jewelry closure of the invention on a hinged ring, in open position.

FIG. 8 shows a hinged ring 40 having elongated members 42, 44 joined by a hinge 46. Magnetic closure members 48, 50, such as are illustrated in FIGS. 1 to 4, are disposed on open ends of ring 40 for engaging together magnetically and mechanically. Plate 52 of the mechanical closure is preferably disposed on the inside of the ring.

Figure 9:
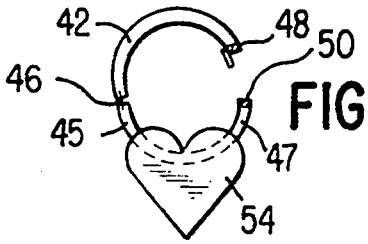
FIG. 9 is a schematic elevational view, partly in cross-section, of a charm having a jewelry closure of the invention.

FIG. 9 illustrates heart-shaped charm 54. Charm 54 may have a ring, such as ring 40, secured to a face of the charm by a portion of member 44, as shown in broken lines in FIG. 9, leaving hinge 46 and closure ends 48, 50 free of the charm. Alternatively, member 44 may be divided into two parts 45, 47, each attached at one end to the charm, leaving hinge 46 and closure ends 48, 50 free of the charm, without needing to secure the portion shown in broken lines across the face of the charm, which might reduce the ornamental quality of the charm.

Figure 10:
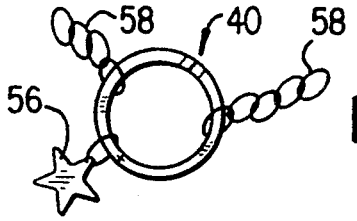
FIG. 10 is a schematic view of another hinged closure for a chain.

FIG. 10 illustrates a ring, such as ring 40 of FIG. 10 having a charm 56, which may be any charm, slipped over ring 40 and also having end links of chain 58 slipped over the ring before securing the closure magnetically and mechanically. Thus ring 40, optionally embellished with charms, can hang decoratively from ends of a chain necklace or bracelet and various chains can be added, according to choice.

Figure 11:
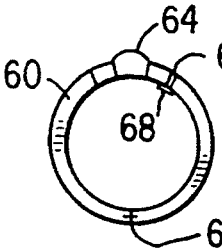
FIG. 11 is a schematic elevational view of a ring of the invention.
Figure 12:
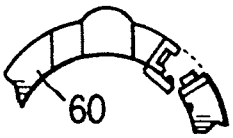
FIG. 12 is an enlarged detail of the ring illustrated in FIG. 11, showing the closure.

FIGS. 11 and 12 show a ring 60 which has a magnetic closure 62 adjacent jewelled portion 64. Hinge 66 allows the ring to be opened and closed to put it on and take it off a finger. Plate 68 is preferably disposed on an inside surface of the ring. Closure 62 is unobtrusively located adjacent the jewelled portion of the ring and hinge 66 is conveniently positioned opposite the jewelled portion. FIG. 12 shows a detail of FIG. 11, which clearly shows a magnetic closure 2 of FIG. 1 used in a ring of FIG. 11.

Other uses for the magnetic/mechanical closure described herein will be apparent to those skilled in the art. Both the magnetic and mechanical closures must be engaged substantially simultaneously to secure the jewelry closure. Likewise both the magnetic and mechanical closures must be released substantially simultaneously to release the jewelry closure.

While the invention has been described above with respect to certain embodiments thereof, variations and modifications may be made without departing from the spirit and scope of the invention.

What is claimed is:

1. A jewelry closure comprising:

a magnetic closure comprising first and second closure members for engaging together magnetically, wherein at least one of said first and second closure members comprises a magnet;

a mechanical closure comprising a mechanical closure member attached to said first closure member for engaging a complementary portion of said second closure member when said second closure member is held by magnetic attraction to said first closure member, wherein said mechanical closure member comprises a plate having a shaped portion and said second closure member comprises a complementarily shaped portion which engages said shaped portion when said magnetic and mechanical closures are secured.

2. A jewelry closure according to claim 1 wherein said shaped portion comprises a bead and said complementarily shaped portion comprises a socket in which said bead is engaged when said magnetic and mechanical closures are secured.

3. A jewelry closure according to claim 1 wherein said shaped portion comprises an elongated ridge and said complementarily shaped portion comprises an elongated channel in which said bead is engaged when said magnetic and mechanical closures are secured.

4. A jewelry closure according to claim 1 wherein said shaped portion comprises a socket and said complementarily shaped portion comprises a bead which is engaged in said socket when said magnetic and mechanical closures are secured.

5. A jewelry closure according to claim 1 wherein said shaped portion comprises an elongated channel and said complementarily shaped portion comprises an elongated ridge which is engaged in said channel when said magnetic and mechanical closures are secured.

6. A jewelry closure according to claim 1 further comprising first and second elongated members wherein said first closure member and second closure member are disposed on first ends of first and second elongated members, second ends of said first and second elongated members being hinged together to form a ring when said magnetic and mechanical closures are secured.

7. A jewelry closure according to claim 6 further comprising a decorative portion secured to at least one of said elongated members.

8. A jewelry closure according to claim 7 wherein said elongated member to which said decorative portion is attached is separated into two parts wherein a first part comprises a magnetic member selected from said first and second closure members and a second part is hinged to said other elongated member.

9. A jewelry closure according to claim 8 mounted on a charm.

10. A jewelry closure according to claim 6 mounted on a ring for a finger.

11. A jewelry closure according to claim 6 mounted on a charm.

12. A ring comprising first and second members hinged together at first ends thereof and joined at second ends thereof by a jewelry closure according to claim 6.

13. A hinged ring for a finger comprising first and second members hinged together at first ends thereof and joined at second ends thereof by a jewelry closure according to claim 6.

14. A charm comprising first and second members hinged together at first ends thereof and joined at second ends thereof by a jewelry closure according to claim 6.

15. A jewelry closure according to claim 1 mounted on a chain.

* * * * *